US005197448A

United States Patent [19]

Porreca et al.

[11] Patent Number: 5,197,448

[45] Date of Patent: Mar. 30, 1993

[54] DUAL ENERGY IGNITION SYSTEM

[75] Inventors: Paul J. Porreca, Medway; Edward A. VanDuyne, Framingham, both of Mass.

[73] Assignee: Massachusetts Institute of Technology, Cambridge, Mass.

[21] Appl. No.: 748,834

[22] Filed: Aug. 23, 1991

[51] Int. Cl.[5] ..... F02P 15/00

[52] U.S. Cl. ..... 123/620; 123/656

[58] Field of Search ..... 123/598, 599, 620, 623, 123/628, 655, 656

[56] References Cited

U.S. PATENT DOCUMENTS

| | | | |
|---|---|---|---|
| 4,136,301 | 1/1979 | Shimojo et al. | 123/620 |
| 4,223,656 | 9/1980 | Hamley . | |
| 4,269,161 | 5/1981 | Simmons | 123/620 |
| 4,292,569 | 9/1981 | Gerry | 123/620 |
| 4,301,782 | 11/1981 | Wainwright | 123/620 |
| 4,345,575 | 8/1982 | Jorgensen | 123/598 |
| 4,506,650 | 3/1985 | Shimojo et al. | 123/620 |

FOREIGN PATENT DOCUMENTS

| | | | |
|---|---|---|---|
| 2724797 | 11/1978 | Fed. Rep. of Germany | 123/620 |
| 124406 | 2/1928 | Switzerland | 123/620 |

OTHER PUBLICATIONS

"The Effect of Ignition System Power on Fast Burn Engine Combustion," Richard W. Anderson (Ford Motor Co.), Society of Automotive Engineers, Inc., Jan. 1987.

"Effects of Spark Plug Design Parameters On Ignition And Flame Development in an SI-Engine," Stefan Pischinger, Dipl.-Ing., RWTH Aachen (1985), Submitted in Partial Fulfillment of the Requirements for the Degree of Doctor of Philosophy at the Massachusetts Institute of Technology, Jan. 1989.

"A Comparative Study of Plasma Ignition Systems," C. F. Edwards and A. K. Oppenheim, SAE Technical Paper Series, SAE The Engineering Resource For Advancing Mobility, International Congress & Exposition, Detroit, Mich., Feb. 28-Mar. 4, 1983.

*Primary Examiner*—Willis R. Wolfe

*Attorney, Agent, or Firm*—Choate, Hall & Stewart

[57] ABSTRACT

An ignition system for hydrocarbon based fuels employing two energy sources, one to create a spark, and the other to sustain an arc. The ignition circuit is based in part on the principle of a strobe light circuit. The circuit increases ignition efficiency by increasing the power dissipated at the spark gap, particularly when used in conjunction with a surface gap spark plug. Maximum power transfer is achieved via impedance matching of the ignition system to a surface gap spark plug. The circuit is particularly appropriate for igniting extremely lean mixtures, highly diluted mixtures, and alternative fuels.

11 Claims, 3 Drawing Sheets

DUAL ENERGY IGNITION SYSTEM

BACKGROUND OF THE INVENTION

This invention relates to ignition systems, and in particular to an ignition system which employs two energy sources, the first to create a spark and the second to sustain an arc.

The goal of any ignition system is to ignite an air/fuel mixture such that a self-sufficient combustion process is initiated after the arcing has stopped. Air/fuel mixtures close to stoichiometric require very little ignition energy to generate a self-sustaining flame kernel. However, generating a self-sustaining flame kernel becomes more and more difficult as the air/fuel ratio deviates further and further from stoichiometric or as the air/fuel mixture becomes diluted with exhaust gas recirculation.

Both Coil Ignition (CI) and Capacitive Discharge Ignition (CDI) systems use one energy storage device to create the spark and to sustain the arc. Problem arise when most or all of the stored energy is consumed to create the spark and no energy is left to sustain an arc. This occurs at certain engine speeds and load ranges. Further problems with CI systems are that they store their energy in a transformer making it an inefficient transformer, and they try to transfer all of their stored energy through this inefficient transformer. The main advantage of Capacitive Discharge Ignition (CDI) is the quick rise time of the very high voltage which immediately breaks down the spark gap, preventing the voltage from slowly dissipating in the circuit. This provides the ability to fire fouled plugs or larger gaps.

Breakdown Ignition (BDI) systems are identical to CDI systems, but include a capacitor in parallel with the spark gap. This capacitor stores energy that is being expended on creating the spark. This stored energy is quickly dissipated upon spark creation in the form of high current arc. There are several problems with this configuration, however. First, the presence of the capacitor increases the rise time of the very high voltage spike, which can cause misfires. Second, the capacitor deprives the spark creation process of energy. To insure that this does not cause misfires, more energy must be stored in the primary capacitor. Efficiency suffers from attempting to force all stored energy in the primary through an inefficient transformer and from having one capacitor charge another capacitor. Finally, the energy requirements for igniting a lean mixture are inversely proportional to the storage characteristics of the capacitor in the secondary. This is because more energy is required to ignite a lean mixture at low pressure while the voltage required to create a spark is lower at low pressures. Since energy can be expressed as $\frac{1}{2}CV^2$, it can be seen that less energy is stored for a lower breakdown voltage.

Supplementary Secondary Energy (SSE) ignition systems have one energy source for the spark and another for the arc in an effort to lengthen arc duration. These systems are basically CDI systems with additional stored energy in the secondary which is discharged upon spark creation. Existing SSE systems are inefficient because the secondary energy discharges through the secondary winding of the transformer, thereby charging the primary capacitor. Examples of such systems are disclosed in U.S. Pat. Nos. 4,136,301 to Shimojo et al. and 4,301,782 to Wainwright. In the '782 patent, an attempt at isolating the discharge path is disclosed, but the method involves placing an inductor in the discharge path. Including an inductor or a resistor (as in U.S. Pat. Nos. 4,345,575 to Jorgenson and 4,269,161 to Simmons) decreases the peak current which dims the arc intensity.

One object of this invention is to improve the ignition process. In particular, one object of this invention is to maximize efficiency by separating the ignition process into two phenomena, the spark and the arc. Another object of this invention is to achieve maximum power transfer of ignition energy from the spark source to the spark gap by better matching the impedance of the spark plug to the impedance of the spark source.

SUMMARY OF THE INVENTION

The present invention is a dual energy ignition system including a first energy source electrically connected to the primary winding of a step-up transformer and a spark gap electrically connected in parallel with the secondary winding of the step-up transformer in such a way that energy released from the first energy source provides energy to the spark gap of sufficient strength and duration to create a spark across the spark gap. The system further includes a second energy source electrically connected in series with the spark gap and secondary winding in such a way that coupling between the second energy source and the primary winding and charging of the second energy source by energy discharged from the secondary winding are minimized, but in such a way that energy released from the second energy source provides energy to the spark gap via a low resistance path, the energy being of sufficient strength and duration to sustain an arc across the spark gap.

In one embodiment, the low resistance path includes a diode oriented to provide low resistance during energy transfer from the second energy source to the spark gap, and oriented to provide high resistance to energy transfer from the second energy source through the secondary winding, thereby decoupling the second energy source from the primary winding.

In another embodiment, the low resistance path includes the secondary winding and the transformer is a saturatable core transformer which decouples the second energy source from the primary winding.

Preferably, the first energy source provides a minimum but sufficient amount of energy to create a spark under operating conditions of interest. In some embodiments, the first energy source includes a magneto, a Kettering with either points or a transistor for switching, or a CDI.

Preferably, the second energy source acts to increase arc current. In some embodiments, the second energy source includes a capacitor with an initial condition.

In preferred embodiments, the spark gap has a narrow impedance delta characteristic such that source impedance and load impedance substantially match. In particular embodiments, a surface gap spark plug is employed toward this goal.

DESCRIPTION OF THE PREFERRED EMBODIMENT

The present invention improves ignition efficiency by separating the ignition process into two phenomena, the spark and the arc. The spark is the initial high voltage ionization and breakdown of matter, along the spark gap, into plasma. The arc is any current present after the initial breakdown. According to the invention, efficiency is improved by dedicating a separate energy-imparting system to each part of the ignition process.

Figure 1A:
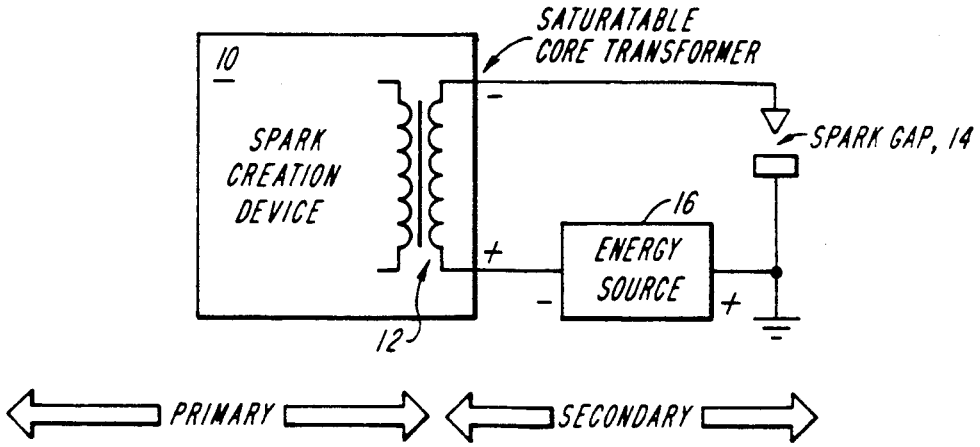
FIGS. 1*a* and 1*b* are circuit diagrams of dual energy ignition systems according to the present invention employing a spark creation device and a second energy source (shown conceptually) and a) a saturatable core transformer and b) a high-voltage diode to decouple the second energy source from the primary.
Figure 1B:
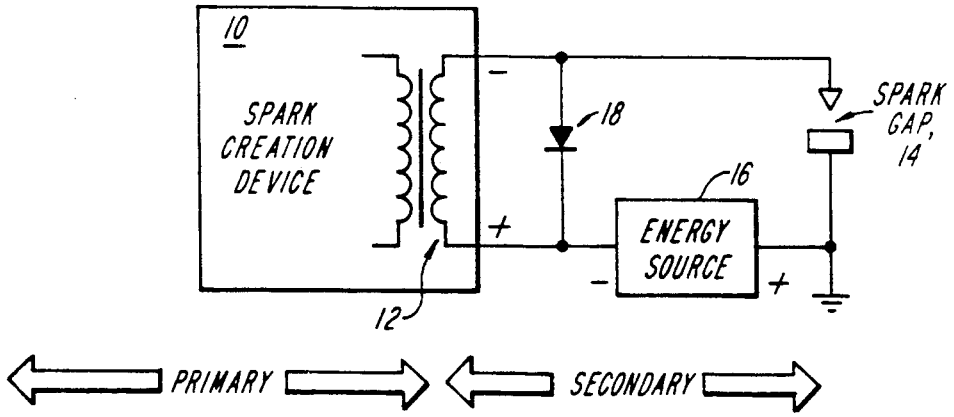

An dual energy ignition circuit according to the present invention is illustrated conceptually in FIGS. 1*a* and 1*b*. A spark creation device 10, including an impedance matching transformer 12, has the sole purpose of creating a spark in a spark gap 14. A second energy source 16 has the sole purpose of creating a high current arc in the spark gap 14. Importantly, the second energy source 16 has a discharge path to the spark gap 14 which is uncoupled from the primary of the transformer 12. In FIG. 1*a*, this is achieved by using a saturatable core transformer for the transformer 12. In FIG. 1*b*, this is achieved via a high-voltage diode 18. The efficiency of the system is improved over the existing systems described above because arc energy is not transferred through an inefficient transformer and the second energy source is not charged with energy from the spark creation device.

It is important that the energy released from the secondary energy source is coupled to the spark gap via a low resistance path. Including a resistor in the path (as in U.S. Pat. Nos. 4,345,575 to Jorgenson and 4,269,161 to Simmons) decreases the peak current which dims the arc intensity.

FIG. 2 shows a preferred embodiment of the ignition circuit according to the invention. In this embodiment, a single power source 20 is used to charge both energy sources. The power source charges a capacitor 22. A capacitor with an extremely low internal inductance and an extremely low internal resistance should be used, such as those commonly used in CDI or strobe light applications. A trigger circuit 24 including a high voltage, high peak current switching device is preferably used to trigger the discharge of the capacitor 22 through the transformer 12. This rapid discharge induces a very high voltage on the secondary winding of the transformer 12. This voltage ionizes the matter surrounding the spark gap 14 and creates a spark. The switching device of the trigger circuit 24 is preferably an SCR, a device common to CDI and strobe circuits. However, other switching devices, such as TRIACS may also be used.

Figure 2A:
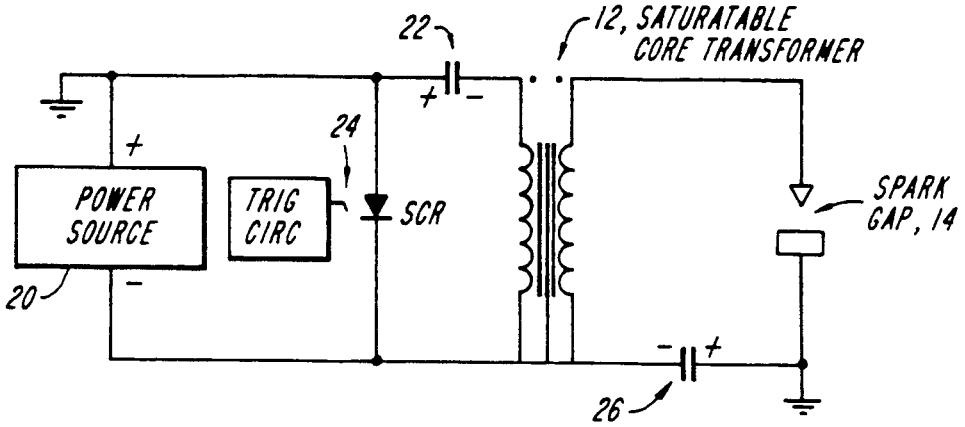
FIGS. 2*a* and 2*b* are circuit diagrams of dual energy ignition systems according to the invention employing a) a saturatable core transformer and b) a high-voltage diode, wherein a single power supply is used to charge both energy sources.
Figure 2B:
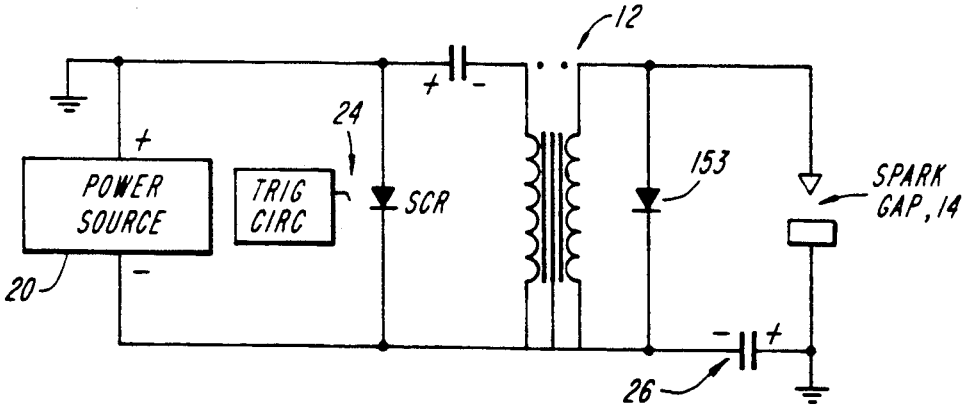

On the secondary side of the transformer 12 is a second capacitor 26, which in this embodiment is also charged by the power source 20. The energy stored in the capacitor 26 will discharge through the spark gap 14 after a spark has been formed. In FIG. 2*a*, the transformer 12 is a saturatable core transformer, used to insure that the discharge of the capacitor 26 is not coupled to the primary of the transformer 12. In FIG. 2*b*, a high-voltage diode 18 is used in place of the saturatable core to achieve the same goal.

Figure 3A:
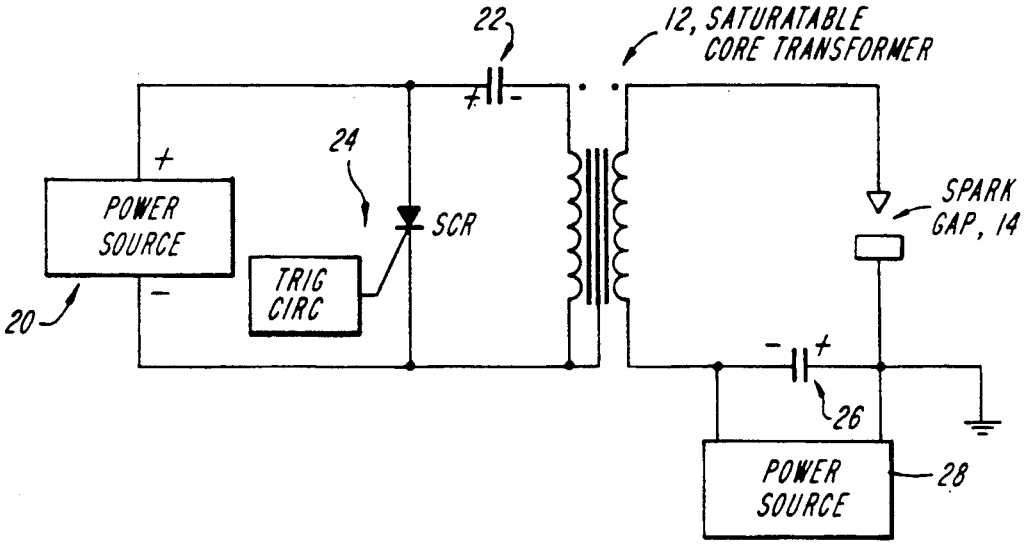
FIGS. 3*a* and 3*b* are circuit diagrams of dual energy ignition systems according to the invention employing a) a saturatable core transformer and b) a high-voltage diode, wherein separate power supplies are used to charge the two energy sources.
Figure 3B:
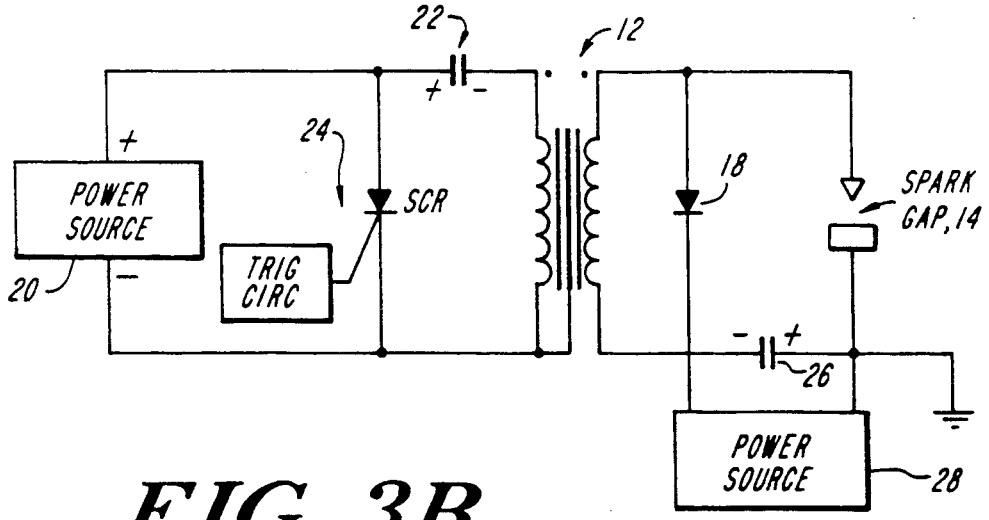

FIG. 3 shows another preferred embodiment of an ignition circuit according to the invention. In this embodiment, a second power source 28 charges the capacitor 26. The outputs of the power sources 22 and 28 need not be identical. In typical embodiments, the power sources 20 and 28 will include DC to DC converters for converting the voltage provided by the automobile (generally 14 volts) to the high voltages required in an ignition system. It should be noted that the circuits illustrated in FIGS. 1–3 can also be used in conjunction with a distributor, although efficiency will suffer.

An advantage of the ignition system of the present invention is derived from the placement of the second energy source in series with the spark gap and the secondary of the transformer. That is, a lower voltage need be generated at the secondary of the transformer by the circuitry on the primary of the transformer since the voltage stored at the second energy source adds to that generated at the secondary. Thus, the secondary need not supply the entire breakdown voltage, but rather the breakdown voltage less the voltage stored at the second energy source.

Referring to FIG. 3, circuit component values will be provided for an illustrative embodiment. In this embodiment, the 0.47 $\mu$F capacitor 22 is charged to 600 volts by the power source 20 which includes a 14 volt-to-600 volt DC to DC converter. The 0.47 $\mu$F capacitor 26 is charged to $-600$ volts by the power source 28 which includes a 14 volt-to-600 volt DC to DC convertor. The trigger circuit 24 includes a 1000 volt 35 amp SCR. The step-up transformer 12 has a winds ratio of 1:100. The high-voltage diode 18 is rated at 40,000 volts and 1 amp.

For the purpose of electromagnetic interference (EMI), shielding is preferably utilized. Also, components are preferably placed close to the spark plug to shorten the high current, EMI generating discharge path.

The ignition system of the present invention is a variation of a strobe type circuit (with about 1/10th of the typically stored energy). Examples are the products of EG&G Electro-Optics of Salem, Mass.. The main difference between a strobe light circuit and the circuit used in the present invention relates to the polarity of firing. A spark plug's center electrode is hotter thereby allowing it to emit electrons more easily. Therefore a lower breakdown voltage is required if the spark plug is fired negatively. However, strobe lights fire positively. Therefore, the ignition circuit preferably has the opposite polarity of firing to that typically used in a strobe light circuit.

Power transfer to the spark gap 14 can be increased by utilizing a projected surface gap spark plug (see *Effects of Spark Plug Design Parameters on Ignition and Flame Development in an SI-Engine*, by Stefan Pischinger, M.I.T. Ph.D. thesis, January 1989). Since power dissipated by a resistor is defined by $P=I^2R$ and an arcing spark gap is like a resistance, the power dissipated at the gap is roughly defined by the same equation. Surface gap spark plugs have greater arc resistance than other typical spark plug configurations. Therefore, power dissipated at the gap is increased by both increasing gap current with a second energy source and by increasing arc resistance with the surface gap spark plugs.

The use of a surface gap spark plug aids impedance matching of the spark gap to the spark generator in the following ways:

1. arcing along a surface lowers breakdown (spark) resistance, thereby lowering the required voltage to create the spark.
2. arcing along the surface raises the discharge (arc) resistance, thereby raising the power dissipated at the spark gap.

Typical spark plug configurations yield high spark resistances and low arc resistances. By lowering the spark resistance and increasing the arc resistance, a surface gap spark plug greatly reduces the range of the spark gap impedance, aiding impedance matching.

One problem with arcing along a surface is that deposits buildup which can cause misfires. The present invention is well-suited for surface gap spark plugs because the quick discharge of secondary energy has a cleaning effect on the surface material.

In previous work, it has been shown that a plasma jet ignition isolated from the combustion chamber, with a quartz plate, ignites the air/fuel mixture almost as well as without the quartz plate (see "Enhanced ignition for I.C. engines with pre-mixed gases," by J. D. Dale and A. K. Oppenheim, SAE paper 810146, 1981). This type of ignition is based on the phenomenon of photolysis. The ignition system of the present invention, combined with the surface gap spark plug, dissipates more power at the gap, and therefore produces a brighter arc which will aid any photochemical/combustion reaction not necessarily local to the plug.

One of the main features of the ignition system of the present invention is its ability to extend the lean operating limit of spark-ignition engines. Lean operation leads to low emission levels and high thermal efficiency. A prototype of an ignition system according to the present invention has been used in automotive engine performance evaluations at steady state operating conditions. The engine used for these studies was a Chevrolet 4.3 liter V-6 spark ignition automobile engine with throttle body injection.

Engine thermal efficiency was measured at discrete speed-load points over a 1500 to 2500 rev/min range and 20 to 100 ft-lb torque range. Fuel consumption was measured gravimetrically and power was computed from the speed and torque requirements. When the engine was run lean of stoichiometric using the ignition system of the present invention, the engine efficiency was improved over the stock configuration by 4–18%, depending on the air/fuel ratio and spark timing.

Engine emission levels (engine out, pre-catalyst) were measured over the operating range described above. HC emission levels from the ignition system of the present invention were comparable or lower than those measured from the stock configuration. At moderately lean air/fuel ratios (approximately 21:1), which is where the best fuel consumption was observed, HC levels were typically lower than stock. At air/fuel ratios greater than 23:1, HC emission increased rapidly as the air/fuel ration increased. CO levels were generally lower than stock by a half to a quarter. $NO_x$ emission levels were a strong function of air/fuel ratio and spark timing. In general, $NO_x$ levels were lower than stock for air/fuel ratios greater than 20:1. Some operating points demonstrated a ten-fold reduction of $NO_x$ emissions from the stock configuration.

The stock engine system with manual timing control was run under lean conditions to evaluate the performance benefit of the ignition system of the present invention. In general, the system extended the lean operating limit approximately 1 to 3 air/fuel ratios. Herein, the lean limit is taken as the point where hydrocarbon emissions increase rapidly as the air/fuel ratio increases. The onset of misfire usually occurs at air/fuel ratios lean of this point.

If engine control strategy is optimized for maximum efficiency, without regard to emissions, it is possible that fuel consumption can be reduced over a stoichiometric engine by approximately 10% on average, depending on the initial engine performance. This reduction in fuel consumption may be even greater if optimized for a limited speed and load range (generator set, for example). In any case, this would apply only to engines with unregulated emissions.

If engine control stragegy is optimized for low $NO_x$ emissions, it is possible that current emission standards (1 g $NO_x$/mi, 0.41 g HC/mi, and 3.4 g CO/mi) can be achieved while also obtaining an improvement in efficiency (perhaps 3–5%). Meeting the emission requirements would likely require a vehicle fuel economy better than 20 miles per gallon as well as a catalyst (oxidation only or three-way catalyst acting as an oxidation catalyst). While it is extremely difficult to extrapolate steady state emission levels to those obtained during the Federal Test Procedure driving cycle, it is estimated a vehicle that obtains 20 mpg and emits less than 180 ppm $NO_x$ under most conditions has a good chance of passing the current 1 g $NO_x$/mile standard. The present invention has demonstrated the ability to operate at air/fuel ratios between 22:1 and 24:1 at speed and load conditions matching those of vehicle acceleration and highway cruise (heavy acceleration and highway cruise are conditions of high $NO_x$ production). $NO_x$ levels were below 180 ppm and brake specific fuel consumption was 4% better than stock.

The Clean Air Act requires future vehicle emission levels of 0.4 g $NO_x$ per mile. Given the test results, it appears possible that a lean combustion engine employing the ignition system of the present invention can obtain this $NO_x$ level in a high fuel economy vehicle obtaining better than 40 mpg. An oxidation catalyst will almost definitely be required to meet HC and CO standards. It would be extremely difficult, and therefore unlikely, that the 0.4 g/mi $NO_x$ standard could be achieved for vehicles that obtain less than 30 to 40 mpg.

In summary, the dual energy ignition system of the present invention proved to be capable of a 3 to 4 air/fuel ratio extension of the lean misfire limit when compared to stock ignition. It is important to note that the ignition system used in these tests was a prototype unit. Additional development and optimization may enhance the results demonstrated in these steady-state proof-of-concept tests.

What is claimed is:

1. An ignition system comprising:

a step-up transformer having a primary and secondary winding;

a first energy source electrically connected to said primary winding;

a spark gap electrically connected in parallel with said secondary winding of said step-up transformer, in such a way that energy released from said first energy source provides energy to said spark gap of sufficient strength and duration to create a spark across said spark gap; and a second energy source electrically connected in series with said spark gap and secondary winding in such a way that coupling between said second energy source and said primary winding and charging of said second energy source by energy discharged from said secondary winding are minimized, but in such a way that energy released from said second energy source provides energy to said spark gap via a low resistance path, the energy of sufficient strength and duration to sustain an arc across said spark gap.

2. The system of claim 1 wherein said low resistance path comprises a diode oriented to provide low resistance during energy transfer from said second energy source to said spark gap, and oriented to provide high resistance to energy transfer from said second energy source through said secondary winding, thereby decoupling said second energy source from said primary winding.

3. The system of claim 1 wherein said low resistance path comprises said secondary winding and wherein transformer core saturation is employed to decouple said second energy source from said primary winding.

4. The system of claim 1, 2, or 3 wherein said first energy source provides a minimum but sufficient amount of energy to create a spark under operating conditions of interest.

5. The system of claim 1, 2, or 3 wherein said first energy source comprises a magneto.

6. The system of claim 1, 2, or 3 wherein said first energy source comprises a Kettering with either points or a transistor for switching.

7. The system of claim 1, 2, or 3 wherein said first energy source comprises a CDI.

8. The system of claim 1, 2, or 3 wherein said energy source acts to increase arc current.

9. The system of claim 1, 2, or 3 wherein said second energy source comprises a capacitor with an initial condition.

10. The system of claim 1, 2, or 3 wherein said spark gap has a narrow impedance delta characteristic such that source impedance and load impedance substantially match.

11. The system of claim 1, 2, or 3 wherein said spark gap is provided by a surface gap spark plug.

* * * * *

UNITED STATES PATENT AND TRADEMARK OFFICE

CERTIFICATE OF CORRECTION

PATENT NO. : 5,197,448

DATED : March 30, 1993

INVENTOR(S) : Paul J. Porrecca, et al

It is certified that error appears in the above-indentified patent and that said Letters Patent is hereby corrected as shown below:

Column 1, line 21: delete "Problem" and insert therefor --"Problems--.

Signed and Sealed this

First Day of March, 1994

Bruce Lehman

*Attest:*

BRUCE LEHMAN

*Attesting Officer*

*Commissioner of Patents and Trademarks*